US009533179B2

(12) United States Patent
Long et al.

(10) Patent No.: US 9,533,179 B2
(45) Date of Patent: Jan. 3, 2017

(54) FIRE DAMPER FOR VENTILATING FAN

(75) Inventors: Min Long, Guangdong (CN); Guancheng Hou, Guangdong (CN)

(73) Assignees: Panasonic Ecology Systems Guangdong Co., LTD. (CN); Panasonic Corporation (JP)

( * ) Notice: Subject to any disclaimer, the term of this patent is extended or adjusted under 35 U.S.C. 154(b) by 669 days.

(21) Appl. No.: 13/809,254

(22) PCT Filed: Jul. 26, 2011

(86) PCT No.: PCT/CN2011/077595
§ 371 (c)(1),
(2), (4) Date: Feb. 5, 2013

(87) PCT Pub. No.: WO2012/013138
PCT Pub. Date: Feb. 2, 2012

(65) Prior Publication Data

US 2013/0130613 A1 May 23, 2013

(30) Foreign Application Priority Data

Jul. 30, 2010 (CN) ..... 2010 1 0244712

(51) Int. Cl.

| | |
|---|---|
| ***F24F 11/02*** | (2006.01) |
| ***A62C 2/12*** | (2006.01) |
| ***F24F 13/14*** | (2006.01) |
| ***F24F 7/013*** | (2006.01) |
| *A62C 2/18* | (2006.01) |
| *F24F 11/00* | (2006.01) |

(52) U.S. Cl.
CPC ..... *A62C 2/12* (2013.01); *F24F 7/013* (2013.01); *F24F 13/14* (2013.01); *A62C 2/18* (2013.01); *F24F 2011/0095* (2013.01)

(58) Field of Classification Search
CPC ..... A62C 2/12; A62C 2/18; F24F 13/14; F24F 2011/0095; F24F 7/013
USPC ..... 454/342, 349, 354, 355, 369; 174/669, 174/67, 485, 542, 556
See application file for complete search history.

(56) References Cited

U.S. PATENT DOCUMENTS

| | | | | |
|---|---|---|---|---|
| 2,862,437 | A * | 12/1958 | Smith et al. | 126/299 D |
| 2,935,007 | A * | 5/1960 | Mercatanti | 454/256 |
| 3,472,150 | A * | 10/1969 | Strawsine | 454/353 |
| 3,908,309 | A * | 9/1975 | Coulter et al. | 49/31 |
| 4,084,744 | A * | 4/1978 | Wilson, Jr. | 236/49.2 |
| 4,223,599 | A * | 9/1980 | Napadow | 454/50 |

(Continued)

FOREIGN PATENT DOCUMENTS

| | | |
|---|---|---|
| CN | 1987121 | 6/2007 |
| CN | 201326575 | 10/2009 |

(Continued)

OTHER PUBLICATIONS

International Search Report for International Application No. PCT/CN2011/077595, dated Nov. 3, 2011.

(Continued)

*Primary Examiner* — Steven B McAllister
*Assistant Examiner* — Frances F Hamilton
(74) *Attorney, Agent, or Firm* — RatnerPrestia

(57) ABSTRACT

A fire damper for a ventilating fan includes a shutter and a frame provided with a flange. An opening is provided on the frame. The frame is further provided with a movable component for covering or uncovering the opening.

5 Claims, 9 Drawing Sheets

(56) References Cited

U.S. PATENT DOCUMENTS 4,304,070 A * 12/1981 Musacchia ..... 49/2
4,901,376 A * 2/1990 Ivey ..... 4/213
5,621,189 A * 4/1997 Dodds ..... H02G 3/0418 174/17 CT
5,787,919 A * 8/1998 Pyle ..... 137/79
6,081,964 A * 7/2000 Mori ..... B60R 16/0222 16/2.2
6,261,175 B1 * 7/2001 Larson et al. ..... 454/354
6,579,169 B1 * 6/2003 Demark ..... E06B 7/02 454/200
7,282,650 B2 * 10/2007 Czuhanich ..... F16L 5/02 16/2.1
7,789,740 B2 * 9/2010 Janesky ..... 454/251
8,569,621 B1 * 10/2013 Shotey ..... H02G 3/14 174/481
8,791,367 B2 * 7/2014 Hartman ..... H02G 3/22 174/152 G
2004/0072538 A1 * 4/2004 Kennedy et al. ..... 454/342
2006/0276120 A1 * 12/2006 Cherry et al. ..... 454/56
2009/0025414 A1 * 1/2009 Koga et al. ..... 62/263
2011/0001408 A1 * 1/2011 Caveney ..... G02B 6/4471 312/296
2011/0234074 A1 * 9/2011 Dolinsek ..... F25D 23/028 312/404

FOREIGN PATENT DOCUMENTS

CN 201779039 * 3/2011
CN 202434845 * 9/2012
GB 191005015 10/1910

OTHER PUBLICATIONS

Written Opinion for International Application No. PCT/CN2011/077595, dated Nov. 3, 2011.

* cited by examiner

100

100

100

100

500

100

FIRE DAMPER FOR VENTILATING FAN

CROSS-REFERENCE TO RELATED APPLICATION

This application claims the benefit of Chinese Patent Application No. 201010244712.X filed on Jul. 30, 2010 in the State Intellectual Property Office of China, the disclosure of which is incorporated herein by reference.

BACKGROUND OF THE INVENTION

Field of the Invention

The present invention relates to a ventilating fan, particularly to a fire damper for a ventilating fan.

Description of the Related Art

Ventilating fan is one of common air exchanging equipments. As shown in FIGS. 1A and 1B, a conventional ventilating fan 100 is provided. The ventilating fan 100 comprises a frame 110 having an opening, a fan 111 and electrical components 112 for driving the fan provided in the frame 110, a adapter 113 provided at air outlet of the fan 111 and connected to pipes to the outdoor, and, a mask 101 provided at an opening section of a ceiling 116 and communicated to the frame 110.

In accordance with the provisions of the laws and regulations in various countries, a refractory protection should be mounted at an air inlet of the ventilating fan to mostly completely isolate the air inlet of the ventilating fan from the indoor. That is, once a fire breaks out, intercommunication (air circulation) between the outdoor and the indoor will be cut off by the refractory protection.

Accordingly, a fire damper 200, as the refractory protection, between the frame 110 and the mask 101 of the ventilating fan 1 having above-mentioned configuration, is needed.

The fire damper 200 comprises a frame 230 having a flange 220 of a quarter shape provided therein and a shutter 210. The shutter 210 comprises a shutter curtain 211, springs 212 provided at both sides of the shutter curtain 211, mounting clamps 214 for the shutter curtain 211, made of thermal fuse components 213, for example tin alloy, etc. The shutter curtain 211 of the shutter 210 is mounted over the flange 220 (that is, near the frame 110 of the ventilating fan) in a folded state. The fire damper 200 is fixed on the frame 110 of the ventilating fan. The mask 101 is mounted on the fire damper 200.

Meanwhile, once an emergency, such as a fire, happens, the thermal fuse components 213 will burn out and the springs 212 will spring out to close up the shutter, so that intercommunication to the outdoor will be cut off around the flange 220. However, once an illumination device 102 is mounted on the mask of the ventilating fan 100, a power cord 103 for the illumination device 102 usually passes through the opening section of the ventilating fan 100 and then is connected to electrical components 112 for the ventilating fan 100. In this case, if a fire damper 200 is provided between the mask 101 and the ventilating fan 100, the power cord should be arranged to keep away from the shutter 210 so as to avoid interference between the shutter 210 and the power cord during closing of the shutter 210.

Like the mask of an illuminating device, for the masks through which the power cord is connected to the ventilation fan and the masks through which no power cord will pass, they cannot share the same fire damper. In the meanwhile the cost of the ventilating fan is reduced.

SUMMARY OF THE INVENTION

The present invention has been made to overcome or alleviate at least one of the above-mentioned problems and drawbacks existing in the prior art.

Accordingly, it is at least an object of the present invention to provide a fire damper for a ventilating fan, which is able to simultaneously cope with the above-mentioned two situations and meets requirements of the laws and regulations.

In order to achieve at least one of the above-mentioned objects, the present invention provides a fire damper for a ventilating fan, wherein the fire damper comprises a shutter and a frame provided with a flange, and, the frame has preformed openings provided thereon and is further provided with a movable component for opening or closing the preformed openings.

In one aspect, the preformed openings are provided on an upper frame section and a lower frame section of the frame, respectively; and, the preformed openings are provided in a paired configuration.

In one aspect, the movable component is provided with a prolonged protruded groove, and an edge portion is provided at a location, corresponding to the preformed openings, at one side of the protruded groove; wherein a power cord is passed through the preformed openings, which are formerly broken through, via the protruded groove, when the protruded groove is mounted over against locations of the preformed openings; and wherein locations of the preformed openings are blocked by the edge portion when the protruded groove is mounted offsetting from locations of the preformed openings.

In one aspect, the movable component has clip members provided at one end thereof and configured to be caught or engaged at the upper or lower end of said frame, and a screw hole formed at the other end thereof through which the movable component is fixed to said frame by screw.

In one aspect, the preformed openings are provided at the flange of the said frame.

In one aspect, the movable component is formed with a through groove of which a prolonged screw hole is formed at one side, and, a block portion is provided at the upper section of the prolonged screw hole along a length direction of said prolonged screw hole; wherein a power cord is passed through the preformed openings, which are formerly broken through, via the through groove, when the through groove is mounted over against locations of the preformed openings; and wherein locations of the preformed openings are blocked by the block portion, when the protruded groove is mounted offsetting from locations of the preformed openings.

As apparent form the above, the fire damper according to the present invention at least has the following advantages and benefits: the masks through which the power cord is connected to the ventilation fan and the masks through which no power cord will pass can share the same fire damper. Accordingly the cost of the product is high.

BRIEF DESCRIPTION OF THE DRAWINGS

The present invention may be understood and its features made apparent to those skilled in the art by referencing the accompanying drawings.

DETAILED DESCRIPTION OF PREFERRED EMBODIMENTS OF THE INVENTION

In the following description, numerous specific details are set forth to provide a more thorough description of the present invention. It will be apparent, however, to one skilled in the art, that the present invention may be practiced without these specific details. In other instances, well-known features have not been described in detail so as not to obscure the invention.

Figure 1A:
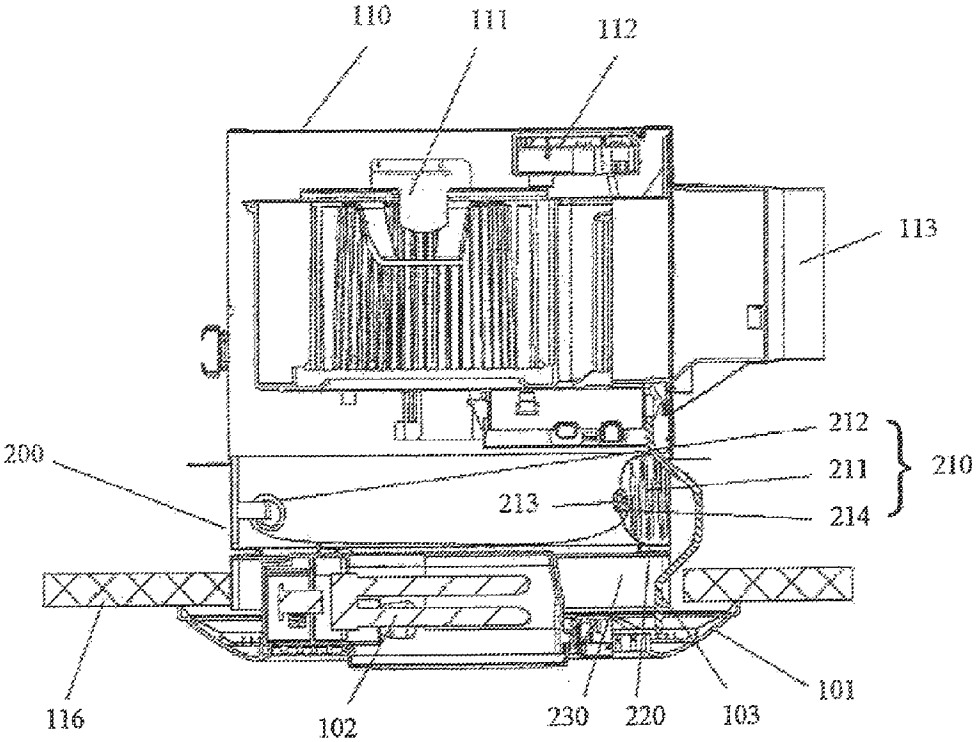
Fig. 1A PRIOR ART
FIGS. 1A, 1B are schematic views of a fire damper for a ventilating fan in the prior art.
Figure 1B:
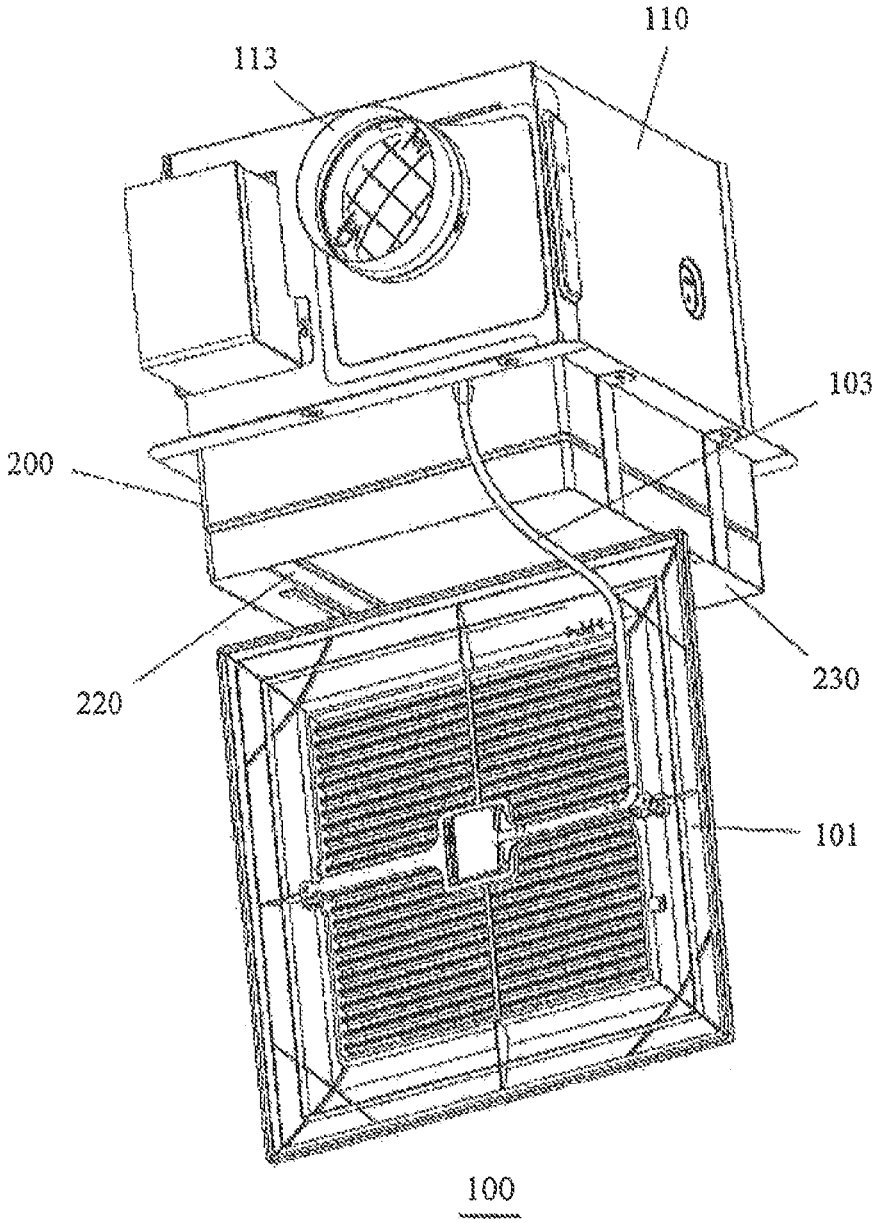
Fig. 1B PRIOR ART
Figure 2A:
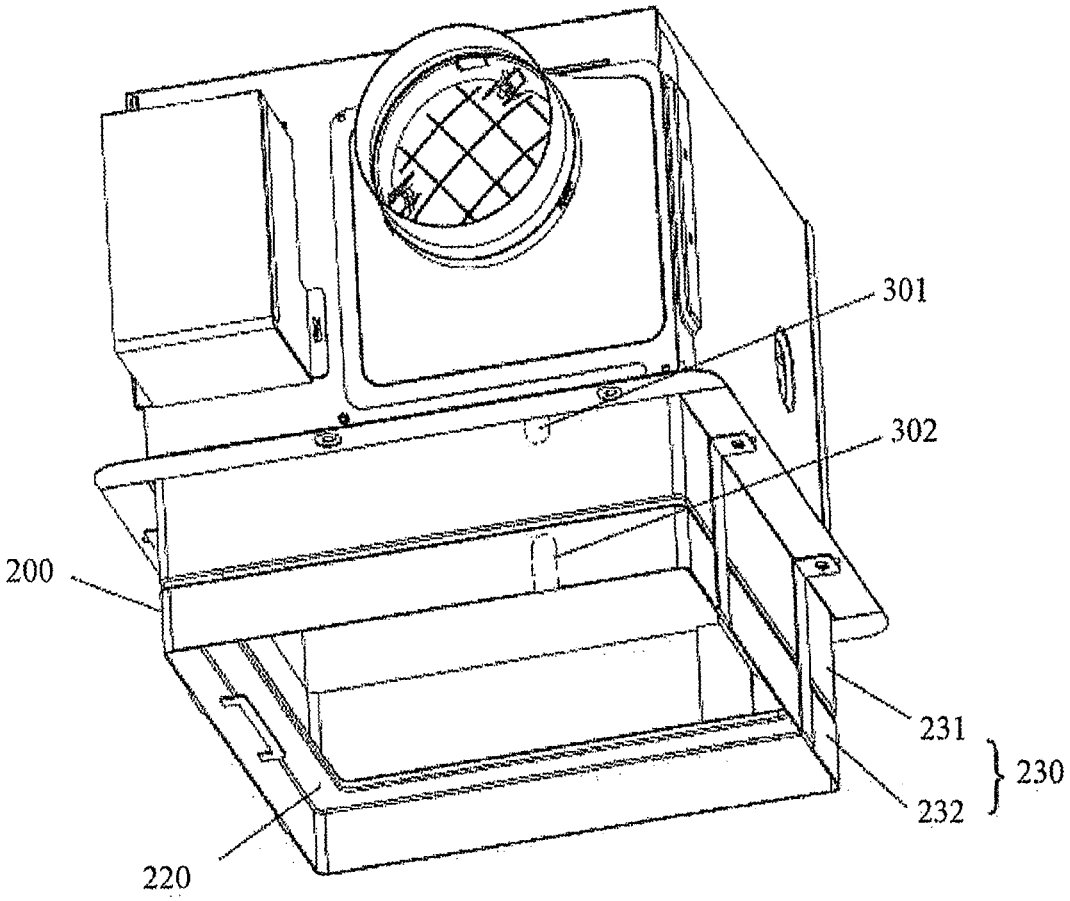
FIGS. 2A, 2B are schematic views of a fire damper for a ventilating fan according to a first embodiment of the present invention.
Figure 2B:
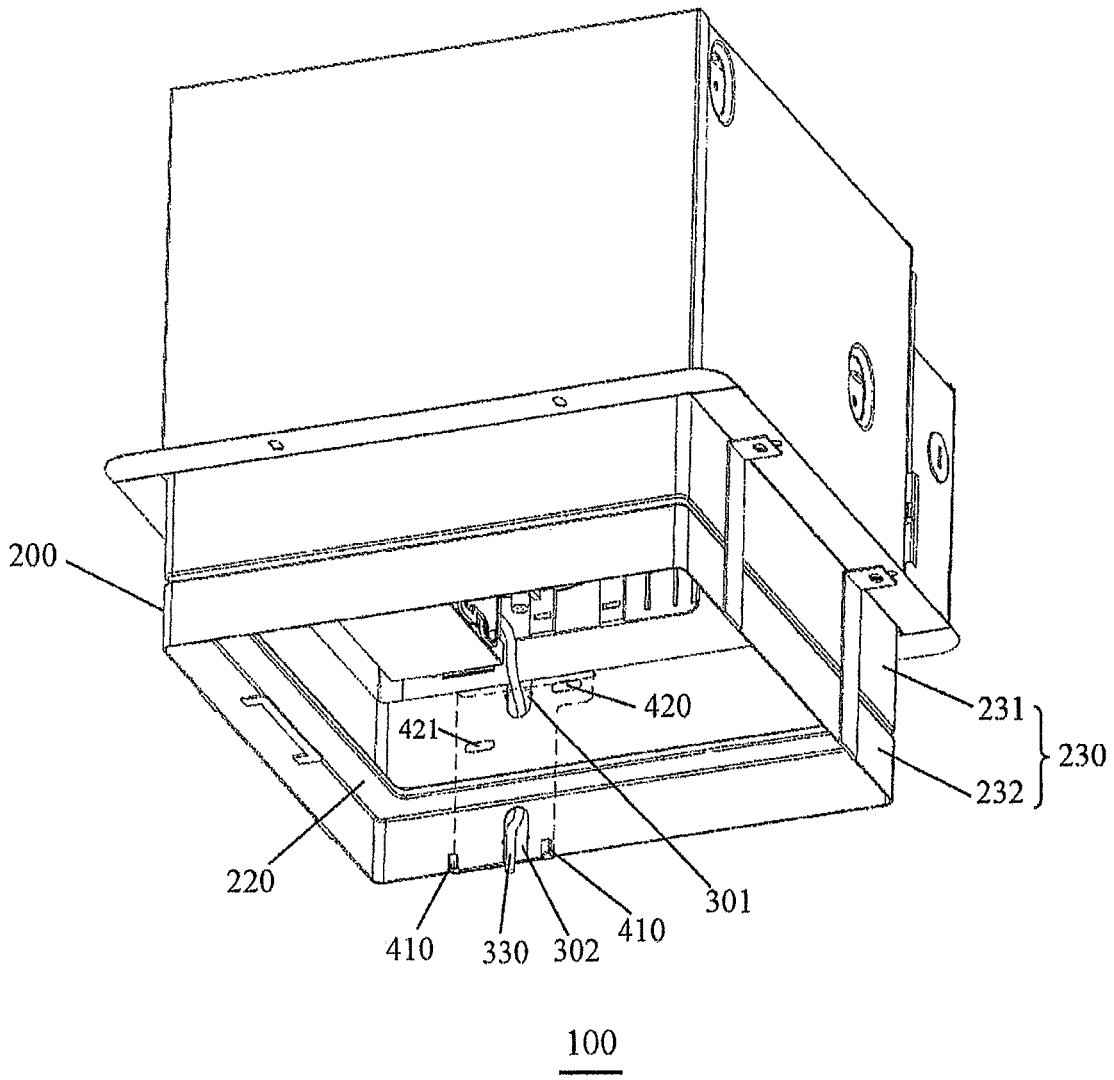

FIGS. 2A, 2B are schematic views of a fire damper having preformed openings according to a first embodiment of the present invention. As shown in the figures, the fire damper 200 for a ventilating fan 100 comprises a shutter (no shown in these figures) and a frame 230 provided with a flange 220. The frame 230 is divided into an upper frame section 231 and a lower frame section 232. The frame 230 has a square configuration. The flange 220 is located at an inner periphery where the upper and lower frame sections meet each other. The flange 220 is sandwiched by the frame 230. The shutter (no shown in these figures) is located in a space enclosed by the flange 220.

The preformed openings 301 and 302 are provided on the upper frame section 231 and the lower frame section 232 of the frame, respectively. The preformed openings 301 and 302 are provided in a paired configuration. The "preformed" means that the openings are not cut out completely, specifically, the openings are in an incomplete cut-out status and have pinhole line (a line with perforations) configurations.

Figure 3:
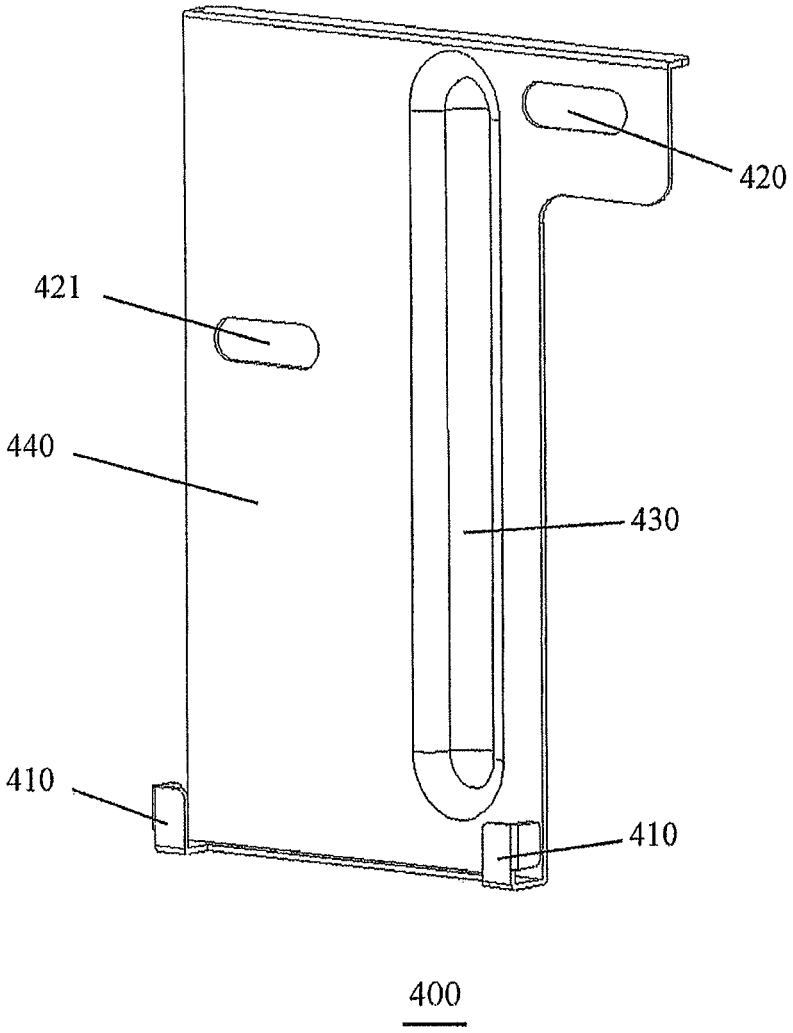
FIG. 3 is a schematic view of a movable component in the fire damper according to the first embodiment of the present invention.

FIG. 3 is a schematic view of a movable component in the fire damper according to the first embodiment of the present invention. As shown in FIGS. 3, 2B, the movable component 400 is an integral component, which has clip members 410 provided at one end thereof and a first screw hole 420 formed at the other end thereof. The clip members 410 are caught or engaged at the lower end 232 of the frame 230. The movable component 400 is fixed to the frame 230 by passing screw through the first screw hole 420. A prolonged protruded groove 430 is provided at the middle of the movable component 400. An edge portion 440 is provided at one side, in a location corresponding to the preformed openings 301 and 302, of the protruded groove 430. Width of the edge portion 440 is slightly greater than that of the preformed openings 301 and 302. The first screw hole 420 and the edge portion 440 are located at both sides of the protruded groove 430, respectively. Further, as shown in FIG. 2B, a second screw hole 421 is provided on the edge portion 440 at a location away from that of the preformed opening 302. The second screw hole 421 is used for strengthening the mounting of the movable component 400 on the frame 230.

As shown in FIGS. 2A, 2B, 3, with the above-mentioned structure, once a mask with a sensor or an illumination is adopted in the ventilating fan 100, passageway is formed by only forming the preformed openings 301 and 302 along the pinhole line. Then, a power cord 330 with a sensor or an illumination is passed through the preformed openings 301 and 302, which are formerly broken through. The passageway presented by forming the preformed openings 301 and 302 of the frame 230 is filled with the power cord 330. And, the power cord 330 is fixed by the movable component 400 to the fire damper frame. Here, the power cord 330 located between the preformed openings 301 and 302 is encircled by the prolonged protruded groove 430, such that, the passageway presented by forming the preformed openings 301 and 302 is completely closed down. When the shutter of the fire damper 200 is closed (no shown in these figures), the air inlet of the ventilating fan 100 is completely isolated from the indoor. That is, the ventilating fan 100 is prevented to inhale the air in the indoor.

Figure 4:
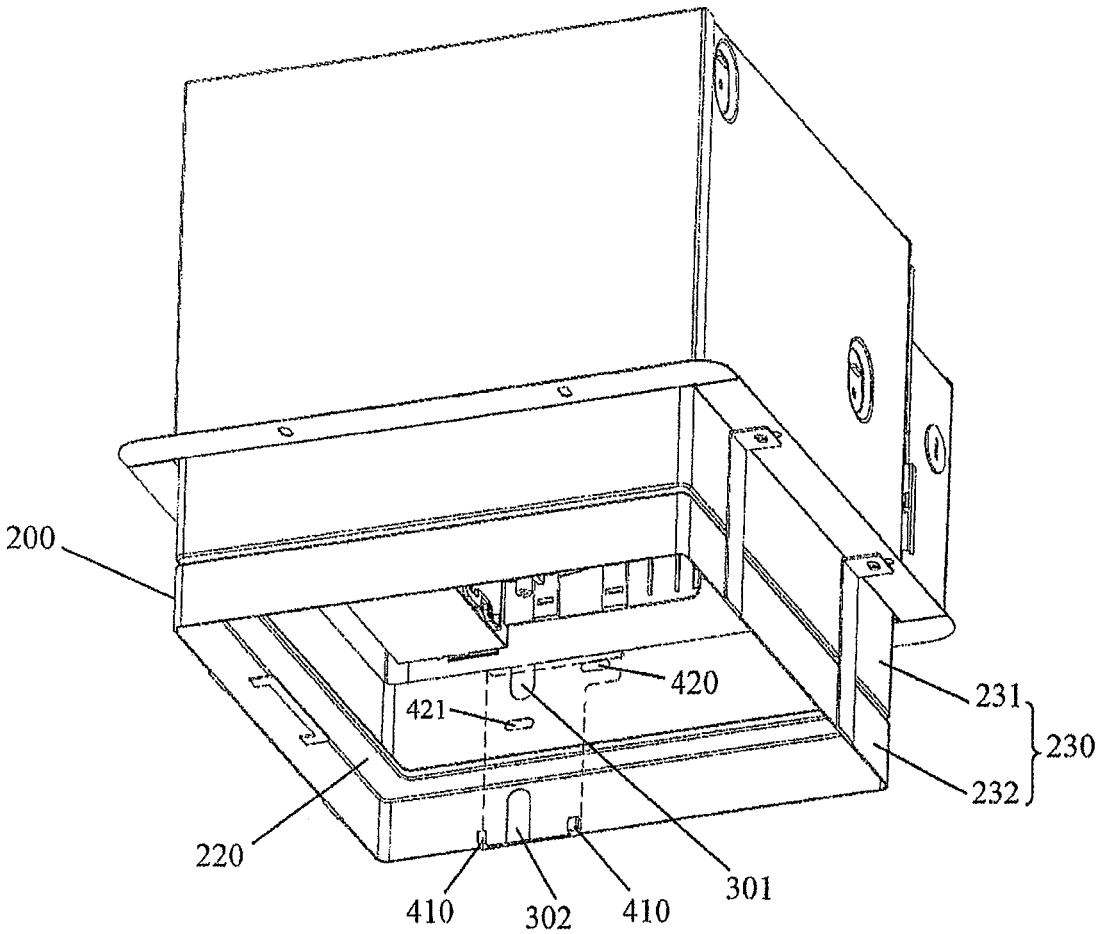
FIG. 4 is a schematic view of the fire damper having no preformed openings, according to the first embodiment of the present invention.

FIG. 4 is a schematic view of the fire damper having no preformed openings according to the first embodiment of the present invention. As shown in FIGS. 4 and 3, once a mask with a sensor or an illumination is not adopted in the ventilating fan 100, the preformed openings 301 and 302 may not be formed. However, if the preformed openings 301 and 302 are formed, the protruded groove 430 of the movable component 400 may offset from locations of the preformed openings 301 and 302 such that the edge portion 440 is over against locations of the preformed openings 301 and 302, thereby blocking the passageway, which is presented by forming the preformed openings 301 and 302, by the edge portion 440. Here, the second screw hole 421 is located between the preformed openings 301 and 302. Then, the movable component 400 is fixed to the frame 230 by passing the screw through the first screw hole 420 and the second screw hole 421 on the movable component 400. When the shutter of the fire damper 200 is closed (no shown in these figures), the air inlet of the ventilating fan 100 is completely isolated from the indoor. That is, the ventilating fan 100 is prevented to inhale the air in the indoor.

In this embodiment of the present invention, the object of that width of the edge portion 440 is slightly greater than that of the preformed openings 301 and 302 is to facilitate the edge portion 440 to block the preformed openings 301 and 302. However, the present invention is not limited to adopt the edge portion 440 has a width slightly greater than or equal to the preformed openings 301 and 302.

The movable component 400 according to the present invention may use two screw holes, instead of the prolonged screw hole. In addition, according to the present invention, the corresponding screw hole may not be provided on the frame, because, normally, with a certain external force, the screw can penetrate directly through the frame of metal sheet.

Figure 5:
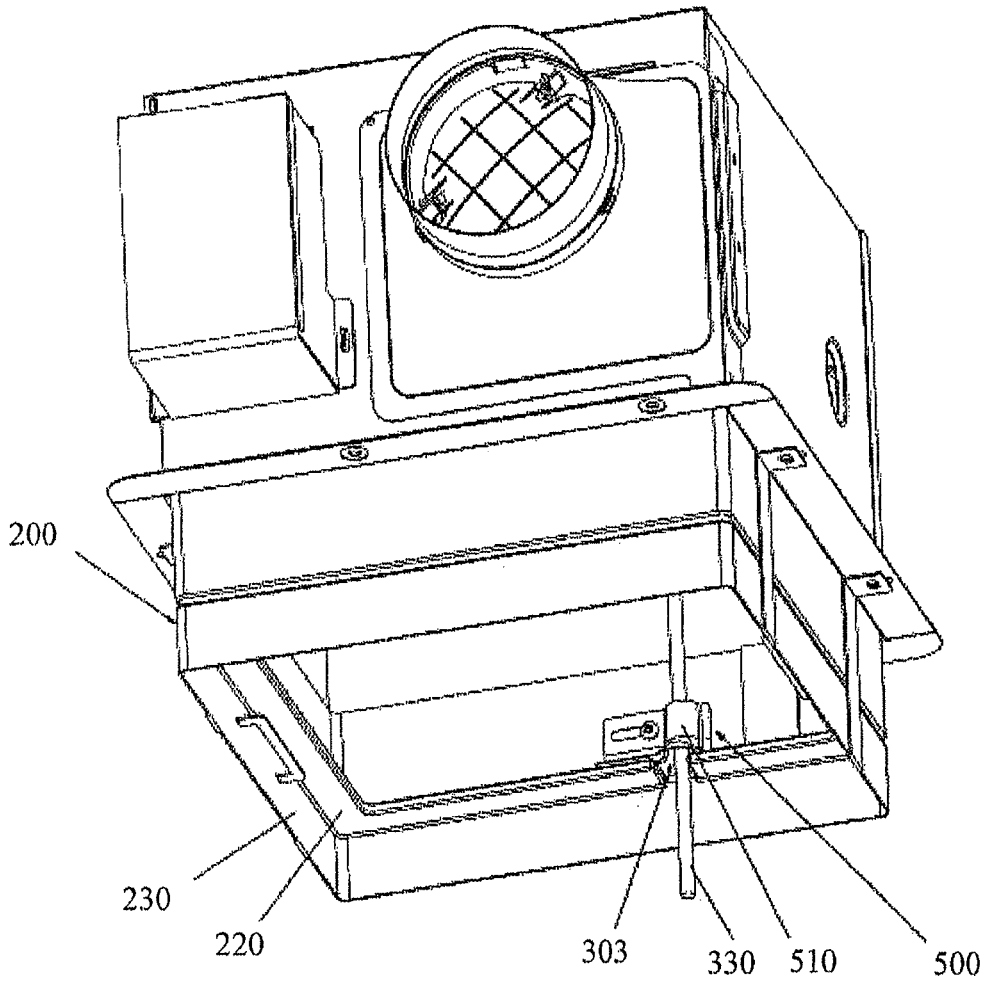
FIG. 5 is a schematic view of the fire damper having a preformed opening according to a second embodiment of the present invention.
Figure 6:
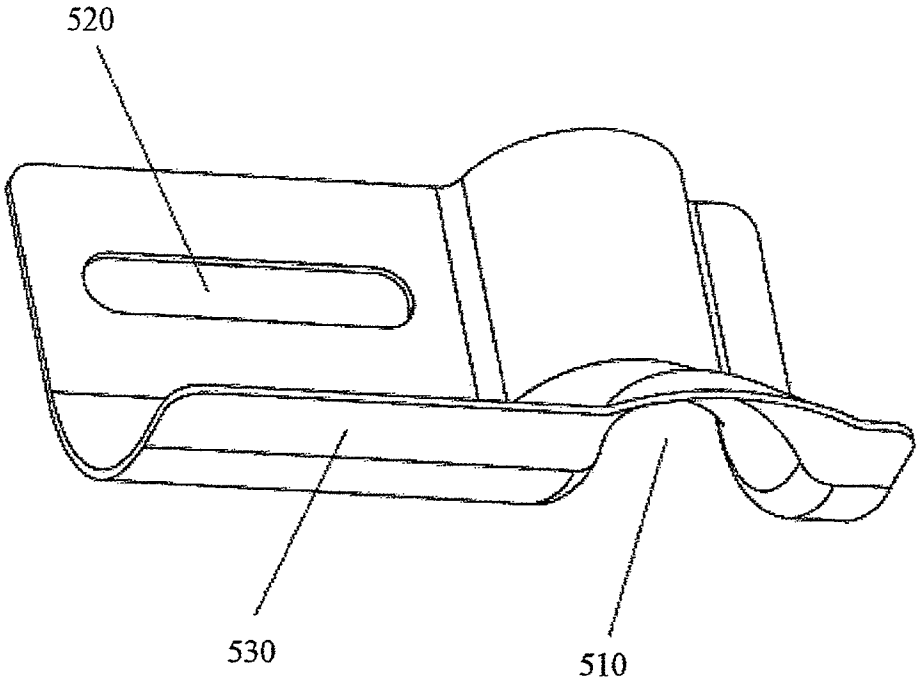
FIG. 6 is a schematic view of a movable component in the fire damper according to the second embodiment of the present invention.

FIG. 5 is a schematic view of the fire damper having a preformed opening according to a second embodiment of the present invention. FIG. 6 is a schematic view of a movable component in the fire damper according to the second embodiment of the present invention. As shown in FIG. 5 and FIG. 6, different from those in the first embodiment, the preformed opening 303 is formed in the flange 220 of the frame 230. The movable component 500 is an integral forming one, which has a through groove 510 configured for passing through the power cord. A prolonged screw hole 520 is formed at one side of the through groove 510. A block portion 530 is provided at the lower section of the prolonged screw hole 520 along a length direction of the prolonged screw hole 520. Size of the block portion 530 is greater than that of the preformed opening 303.

With the above-mentioned structure, once a mask with a sensor or an illumination is adopted in the ventilating fan 100, passageway is presented by only forming the preformed opening 303 of the flange 220 of the frame along the pinhole line. Then, a power cord 330 with a sensor or an illumination is passed through the preformed opening 303. The passageway formed by the preformed opening 303, which is formerly broken through, of the flange 220 of the frame is filled with the power cord 330. And, the power cord 330 is fixed by the through groove 510 of the movable component 500 to the frame 230. Here, the passageway presented by forming the preformed opening 303 is completely closed down. When the shutter of the fire damper 200 is closed (no shown in these figures), the air inlet of the ventilating fan 100 is completely isolated from the indoor. That is, the ventilating fan 100 is prevented to inhale the air in the indoor.

Figure 7:
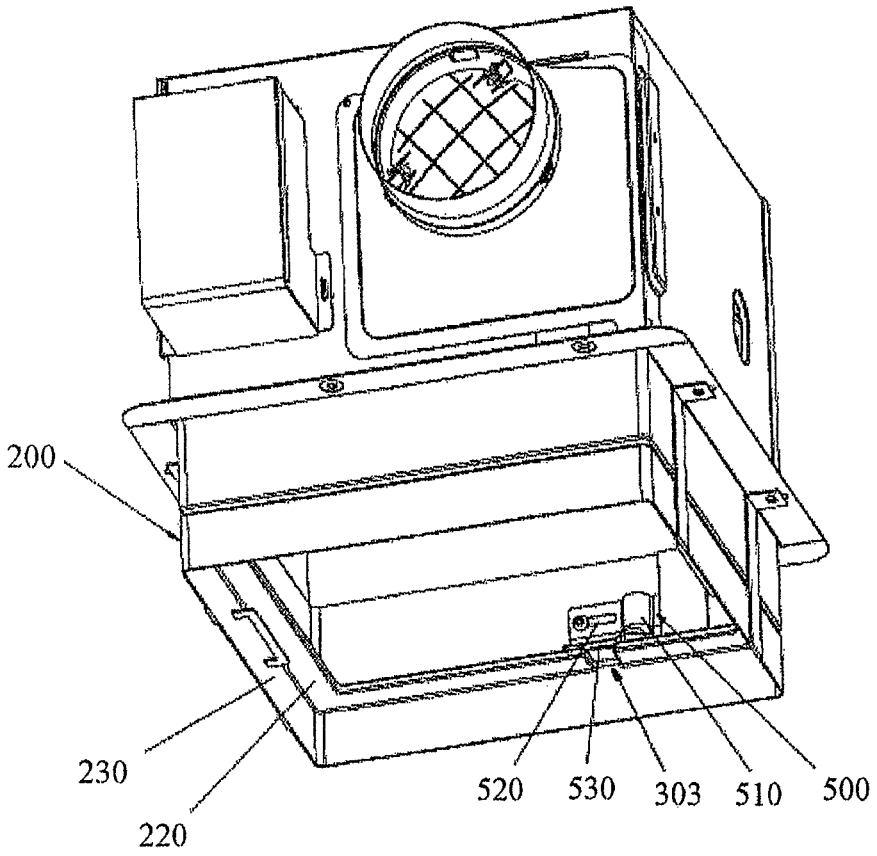
FIG. 7 is a schematic view of the fire damper having no preformed openings, according to the second embodiment of the present invention.

FIG. 7 is a schematic view of the fire damper having no preformed openings according to the second embodiment of the present invention. As shown in FIG. 7 and FIG. 6, once a mask with a sensor or an illumination is not adopted in the ventilating fan 100, the preformed opening 303 may not be formed. However, if the preformed opening 303 are formed, the through groove 510 of the movable component 500 may offset from location of the preformed opening 303 such that the block portion 530 is over against location of the preformed opening 303, thereby blocking the passageway, which is presented by forming the preformed opening 303. Then, the movable component 500 is fixed to the frame 230 by passing the screw through the prolonged screw hole 520 of the movable component 500. When the shutter of the fire damper 200 is closed (no shown in these figures), the air inlet of the ventilating fan 100 is completely isolated from the indoor. That is, the ventilating fan 100 is prevented to inhale the air in the indoor.

In this embodiment of the present invention, the object of that length and width of the block portion 530 is slightly greater than those of the preformed opening 303 is to facilitate the block portion 530 to block the preformed opening 303. However, the present invention is not limited to adopt the block portion 530 has a size slightly greater than or equal to the preformed opening 303.

In addition, the through groove 510 of the movable component 500 partly may act as a locating piece of the shutter, that is, a section into which the shutter will run during the closing. The through groove 510 exists, whether the preformed opening is adopted or not.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A fire damper and ventilating fan assembly, the ventilating fan assembly comprising a ventilating fan, a power cord, a fixture, and the fire damper comprising a shutter and a frame provided with a flange, wherein the frame defines at least two frame openings therethrough, and the frame is further provided with a movable component that is configured to move between a first position and a second position, wherein said movable component comprises a first and second portion, said first portion defines an elongated protruded groove thereon and said second portion defines a planar edge portion;

wherein when the movable component is in the first position the power cord is inserted into a first frame opening of said at least two openings, is passed along a passageway constructed between an underside of the elongated protruded groove of the first portion of the moveable component, and then passes through a second frame opening of said at least two openings, such that the power cord passes from a fire damper upstream side to a fire damper downstream side exteriorly of the fire damper, and is capable of providing power to the fixture when the fire damper is in a dosed position, and wherein when the movable component is in the second position, the first and second frame openings are occluded by the second planar edge portion.

2. The fire damper according to claim 1, wherein said first frame opening is defined on an upper frame section and said second frame opening is defined on a lower frame section of the frame, respectively; and, said first and second frame openings are provided in a paired configuration.

3. The fire damper according to claim 1, wherein said movable component has clip members provided at one end thereof and configured to be caught or engaged at one of an upper end and a lower end of said frame, and a screw hole formed at the other of the upper end and the lower end and through which the movable component is fixed to said frame by a screw.

4. The fire damper according to claim 1, wherein said at least two frame openings are provided at the flange of said frame.

5. The fire damper according to claim 1, wherein each of the at least two frame openings is not cut out completely, is originally in an incomplete cut-out status, and has a pinhole line configuration, and each frame opening is formed by removing material from the frame along the pinhole line configuration.

* * * * *